US007028507B2

(12) United States Patent
Rapport

(10) Patent No.: US 7,028,507 B2
(45) Date of Patent: Apr. 18, 2006

(54) ARTICLE OF JEWELRY

(75) Inventor: Abbie Rapport, Northridge, CA (US)

(73) Assignee: Broadway Entertainment, Inc., Santa Monica, CA (US)

( * ) Notice: Subject to any disclaimer, the term of this patent is extended or adjusted under 35 U.S.C. 154(b) by 0 days.

(21) Appl. No.: 10/841,673

(22) Filed: May 10, 2004

(65) Prior Publication Data

US 2005/0005637 A1 Jan. 13, 2005

Related U.S. Application Data

(63) Continuation-in-part of application No. 10/407,780, filed on Apr. 3, 2003, now abandoned.

(51) Int. Cl.
*A44C 5/00* (2006.01)

(52) U.S. Cl. ..... 63/3; 63/18

(58) Field of Classification Search ..... 63/1.11, 63/1.12, 1.14, 1.16, 1.18, 3–4, 33, 40, 18; 40/209, 732, 642.02, 757, 761, 763, 764, 40/768, 777, 778, 800

See application file for complete search history.

(56) References Cited

U.S. PATENT DOCUMENTS

| | | | | | |
|---|---|---|---|---|---|
| 365,853 | A | | 7/1887 | Palmer | |
| 1,319,201 | A | * | 10/1919 | Bodizsar | 63/4 |
| 1,701,610 | A | * | 2/1929 | Forstner | 63/4 |
| D98,374 | S | | 1/1936 | Taylor | |
| 2,145,071 | A | * | 1/1939 | Cave | 63/3 |
| 2,322,461 | A | | 6/1943 | Mariano | |
| D175,089 | S | | 7/1955 | Newmark | |
| 3,686,894 | A | * | 8/1972 | Handler et al. | 63/19 |
| 4,351,166 | A | * | 9/1982 | Belin | 63/15 |
| 4,664,533 | A | * | 5/1987 | Wollman | 368/282 |
| 4,753,086 | A | * | 6/1988 | Schmidt | 63/3 |
| 5,081,852 | A | * | 1/1992 | Cox | 63/3 |
| D340,651 | S | | 10/1993 | Lassigne | |
| D340,871 | S | | 11/1993 | Iwamura | |
| D399,448 | S | | 10/1998 | Dunlap | |
| 5,950,287 | A | * | 9/1999 | Cacciatore et al. | 27/1 |
| 6,035,571 | A | * | 3/2000 | Hsu | 40/757 |
| 6,094,939 | A | * | 8/2000 | Gavello | 63/3 |
| D463,308 | S | | 9/2002 | Skiles | |
| 6,532,766 | B1 | * | 3/2003 | Chia et al. | 63/26 |
| 6,629,434 | B1 | * | 10/2003 | Chia et al. | 63/26 |

* cited by examiner

*Primary Examiner*—Robert J. Sandy
*Assistant Examiner*—Ruth C. Rodriguez
(74) *Attorney, Agent, or Firm*—Rapkin, Gitlin & Beaumont

(57) ABSTRACT

An article of jewelry comprising a bracelet having a single framed compartment or a plurality of framed compartments each of which releasably receives a photograph or some similar medium with indicia thereon. Each framed compartment is formed of a rear plate for containing and protecting the back of the photograph(s) and four sidewalls integrally formed therewith. Openings are formed in two of the opposing sidewalls to receive a thin resilient cord or the like employed to connect the framed compartments in a series or a single framed compartment to various other desired objects. A separate opening is formed within the rear plate to receive an implement to facilitate the removal of the photograph. Spacer members are provided to keep the series of framed compartment equally separated from the next and ensure the bracelet's overall flexibility.

17 Claims, 6 Drawing Sheets

FIG. 1
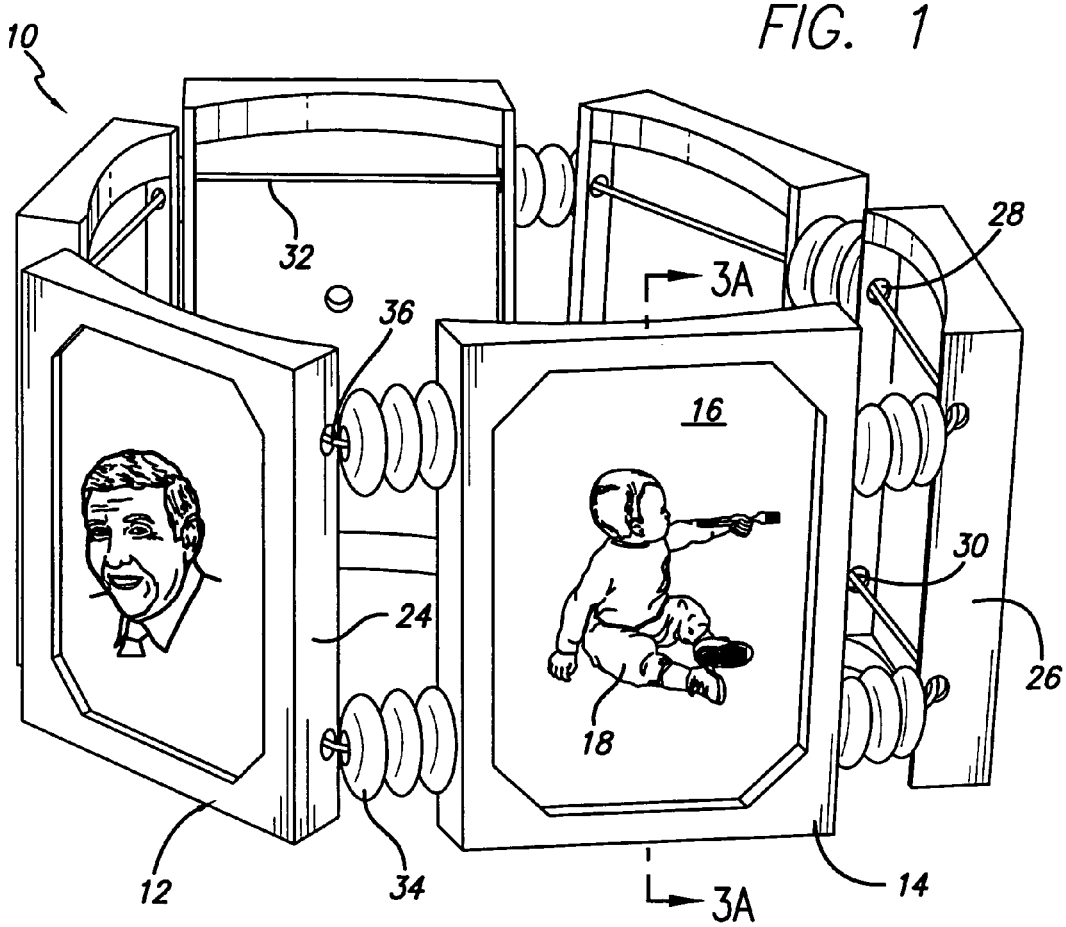
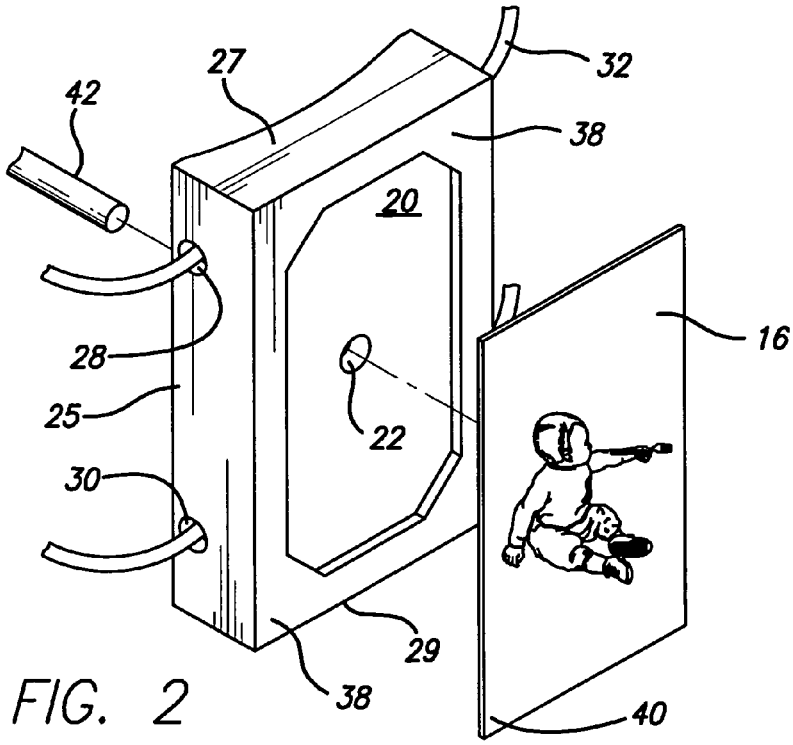
FIG. 2

FIG. 4
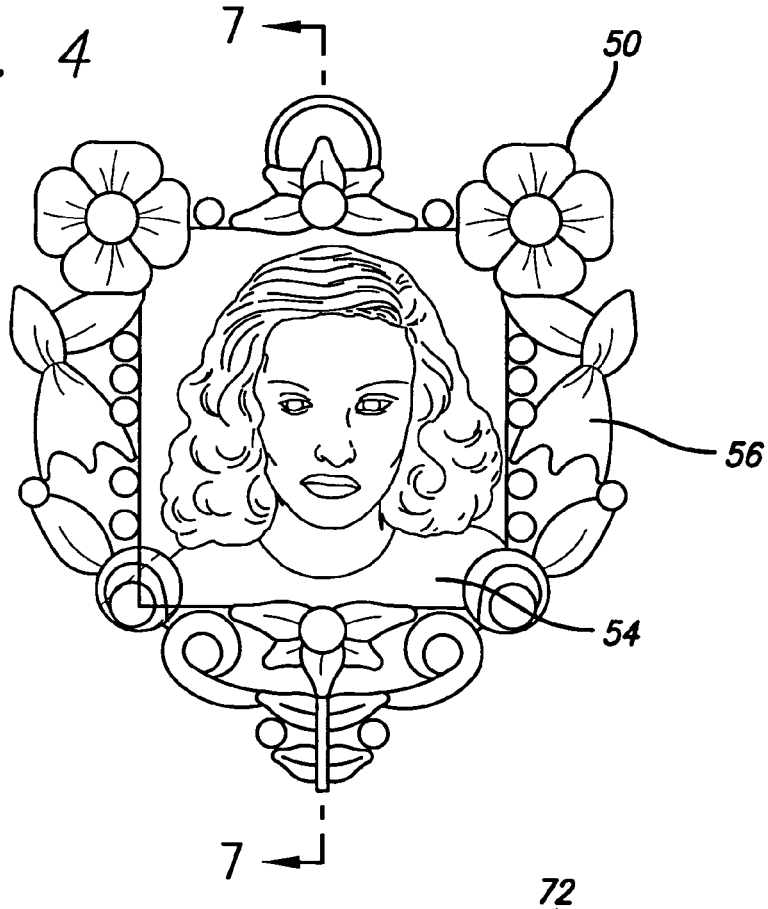
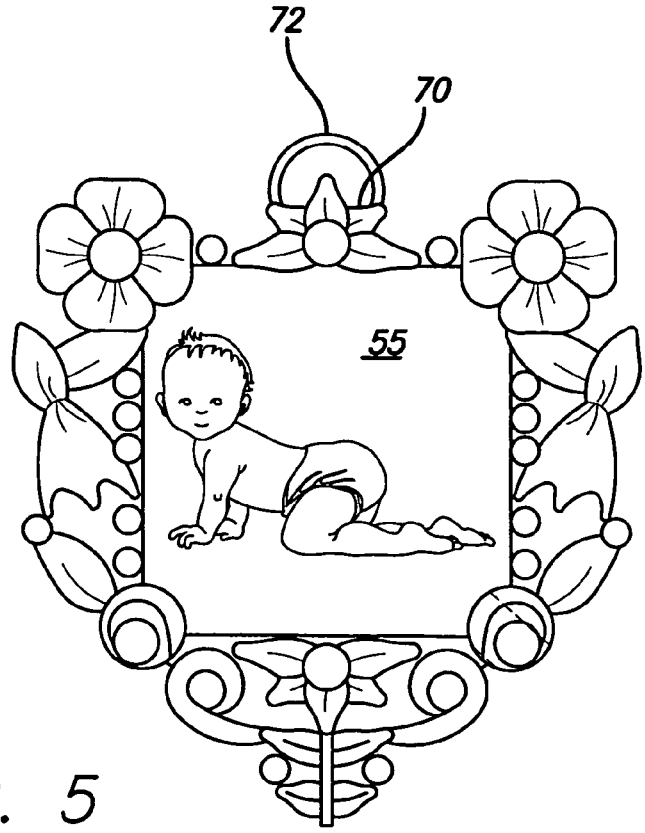
FIG. 5

ARTICLE OF JEWELRY

This is a continuation-in-part of application Ser. No. 10/407,780 filed on Apr. 3, 2003, now abandoned.

BACKGROUND OF THE INVENTION

1. Field of the Invention

The present invention relates generally to the field of jewelry and, more particularly to an improved bracelet, pendant or other article of jewelry for displaying and interchanging individual or multiple photographs or similar keepsakes.

2. Description of the Prior Art

Articles of jewelry for displaying photographs or some other kind of object bearing indicia for wearing on a person's wrist, around the neck or elsewhere on the body or on the clothing are well known in the prior art.

Included among these prior art references are the articles of jewelry shown in U.S. Pat. No. 1,319,201 granted Oct. 21, 1919 to Boldizsar; U.S. Pat. No. 2,145,071 granted Jan. 24, 1939 to Cave; and U.S. Pat. No. 5,081,852 granted Jan. 21, 1992 to Cox.

Cox discloses a bracelet with a rigid band containing individual compartments with removable windows for displaying photographs.

Boldizsar discloses an item of jewelry that includes linked compartments for receiving photographs or the like, and a rear plate formed with an upwardly extending bezel to secure the photograph. A cover is employed as a frame and requires more than a simple manipulation to remove.

Cave discloses articles of jewelry comprised of rings, brooches, pendants and bracelets, among others, that display photographs beneath precious, non-precious or artificial stones of supreme clarity and transparency.

Neither the aforesaid references nor anything else known in the prior art discloses the improvements of the present invention directed to a pendant or a bracelet, or some other item of jewelry with components that are connected to enable the enhancement of its aesthetic features and the individual or multiple photographs displayed therein to be secured and easily removed and replaced, but without the major deficiencies of any of its precursors in the prior art.

SUMMARY OF THE INVENTION

In its preferred embodiment the present invention provides an article of jewelry comprising a bracelet having a plurality of framed compartments for releasably receiving a photograph or some similar medium with indicia thereon. The framed compartments are formed of an integral rear plate for containing and protecting the back of the photograph and four contiguous sidewalls integrally formed therewith. Openings are formed flush with two of the opposing sidewalls to receive a thin resilient cord or the like employed to connect the framed compartments in a series. A separate opening is formed within the integral rear plate to receive an implement to facilitate the removal of the photograph. Spacer members are provided to keep each framed compartment equally separated from the next and ensure the bracelet's overall flexibility and aesthetic quality.

An alternative embodiment of the present invention includes an article of jewelry comprising a framed compartment for use individually as a pin, pendant or broach or in combination with certain other articles of jewelry to form a bracelet or a necklace. The framed compartment is formed of an integral plate for containing and protecting the back of the photograph. A continuous sidewall integrally formed with the framed compartment is provided to further contain and secure the photograph. An opening is formed generally flush with the sidewall for receiving an implement, which is inserted through the opening and behind the photograph to manipulate and facilitate the removal of the photograph from the framed compartment.

Another alternative embodiment of the present invention provides an article of jewelry comprising a framed compartment for use individually as a pin, pendant or broach or in combination with certain other articles of jewelry to form a bracelet or a necklace. The framed compartment is formed of an integral plate for containing and protecting the backs of two photographs and for use in separating the two photographs from one another. Integrally formed with the framed compartment is a sidewall with means formed generally flush therewith for receiving an implement to dislocate either photograph its side of the framed compartment. The means formed within the sidewall for receiving the implement consists of a small opening to which the implement is inserted and manipulated between the photographs and then to one side or the other depending upon the choice of the photographs to be dislodged and removed from the framed compartment.

Accordingly, it is an object of the present invention to provide an improved article of jewelry.

Another object of the present invention is to provide an improved article of jewelry that enables the enhancement of the aesthetic features of the article.

Still another object of the present invention is to provide an improved article of jewelry that enables the photographs displayed in its framed components to be secured and easily removed and replaced.

Still another object of the present invention is to provide an improved article of jewelry with an enhanced flexibility.

Still another object of the present invention is to provide an improved article of jewelry that is easy and cost effective to manufacture.

Still another object of the present invention is to provide an improved article of jewelry with a single framed component.

Still another object of the present invention is to provide an improved article of jewelry with a framed component in combination with assorted other aesthetically pleasing objects.

Still another object of the present invention is to provide an improved article of jewelry with a transparent film for protecting the front surface of the photograph and assist in securing the photograph within the framed component.

Still another object of the present invention is to provide an improved article of jewelry for use individually as a pin, pendant or broach having the means therein to hold and secure one or more photographs.

Still another object of the present invention is to provide an improved article of jewelry for use individually as a pin, pendant or broach having an opening therein for receiving an implement which is then manipulated behind or between the photograph(s) to cause the photograph(s) to dislocate from their framed compartment(s).

Other objects and advantages of the present invention will become apparent in the following specifications when considered in light of the attached drawings wherein the preferred embodiment of the invention is illustrated.

BRIEF DESCRIPTION OF THE DRAWINGS

FIG. 1 is a perspective view of the improved article of jewelry according to the present invention.

FIG. 2 is an enlarged perspective view of a single framed compartment demonstrating the means for removing a photograph according to the present invention.

FIG. 4 is a front elevational of a pendant according to an alternative embodiment of the present invention.

FIG. 5 is a rear elevational view of a pendant according to an alternative embodiment of the present invention.

DETAILED DESCRIPTION OF THE PREFERRED EMBODIMENT

Figure 3A:
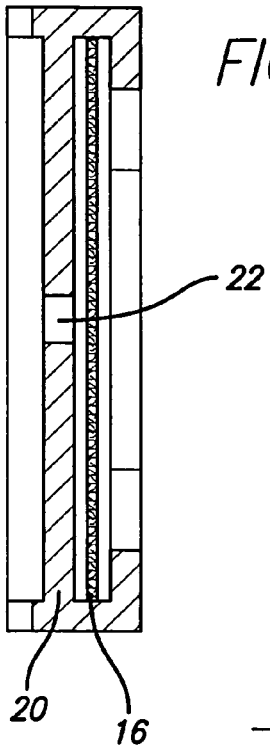
FIG. 3A is an enlarged sectional view of a single framed compartment containing a photograph according to the present invention.

Referring more particularly to the drawings, FIG. 1 is a perspective view of the present invention depicting an article of jewelry 10. Article of jewelry 10 consists of bracelet 12, which is comprised of a plurality of framed compartments 14 for releasably receiving a photograph 16 or some similar medium with indicia 18 thereon. Compartment 14 includes a rear plate 20 with an opening 22 therein and upwardly extending sidewalls 24, 25, 27 and 29 along each side 26 of framed compartment 14 integrally formed therewith. Rear plate 20 may also include assorted other openings (not shown) of various shapes and sizes to reduce costs of materials and contribute to the article's aesthetic appeal.

Openings 28 and 30 are formed generally flush within opposing sidewalls 24 and 25 for receiving a cord or wire 32 for connecting multiple compartments 14 in a series. Spacer elements 34, which are secured as a component of bracelet 12 by threading wire 32 through individual openings 36, are provided to separate each of the compartments 14 from the next and enhance the overall flexibility and high aesthetic quality of bracelet 12. Brackets 38 are provided to retain the corners 40 of photograph 16 securely within each compartment 14. Also used to retain photograph 16 within each compartment 14 are pieces of transparent film (not shown) of generally the same shape and size as photograph 16.

Figure 3B:
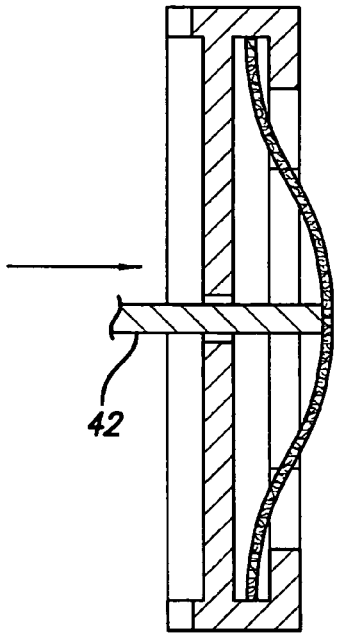
FIG. 3B is an enlarged sectional view of a single framed compartment displaying an implement pushing through the opening in the rear plate to remove the photograph according to the present invention.
Figure 3C:
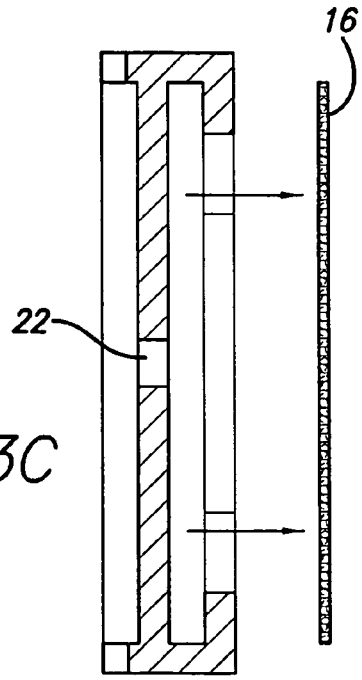
FIG. 3C is an enlarged sectional view of a single framed compartment with the photograph shown removed according to the present invention.
Figure 6:
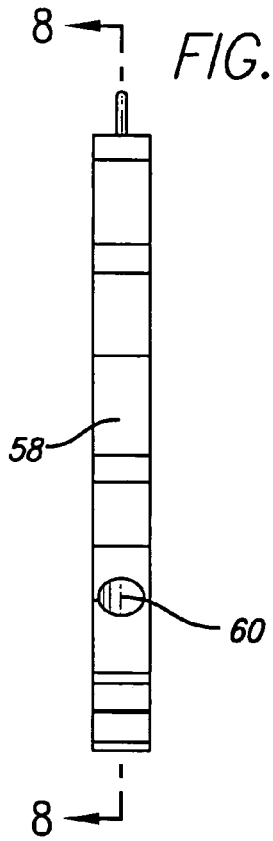
FIG. 6 is a side elevational view of a pendant in accordance with an alternative embodiment of the present invention.
Figure 7:
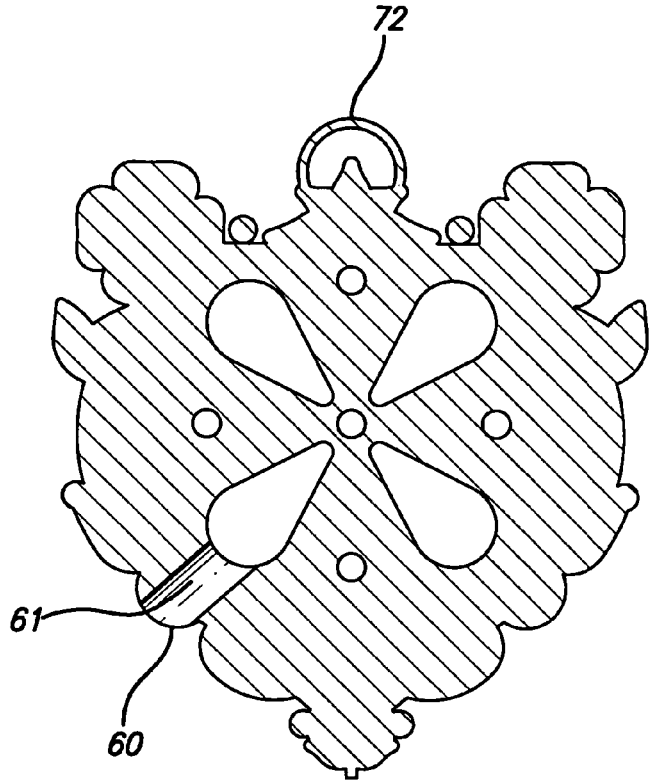
FIG. 7 is a sectional view of a pendant according to an alternative embodiment of the present invention shown along line 7—7 of FIG. 4.
Figure 8:
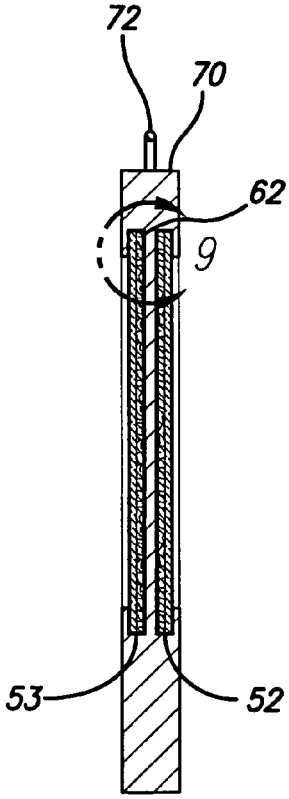
FIG. 8 is a side sectional view of a pendant according to an alternative embodiment of the present invention.
Figure 9:
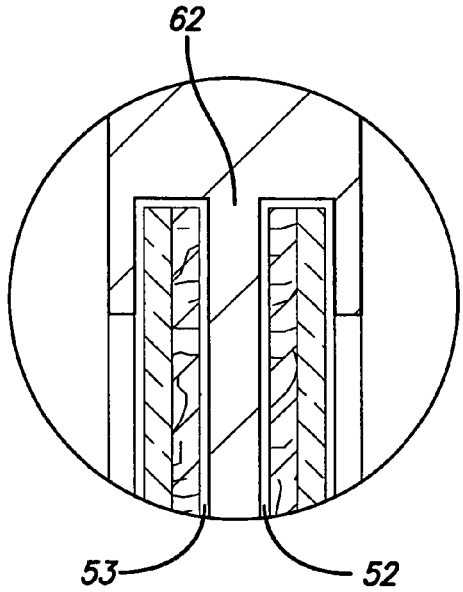
FIG. 9 is an enlarged view showing the area encircled and designated 6 in FIG. 8.
Figure 10:
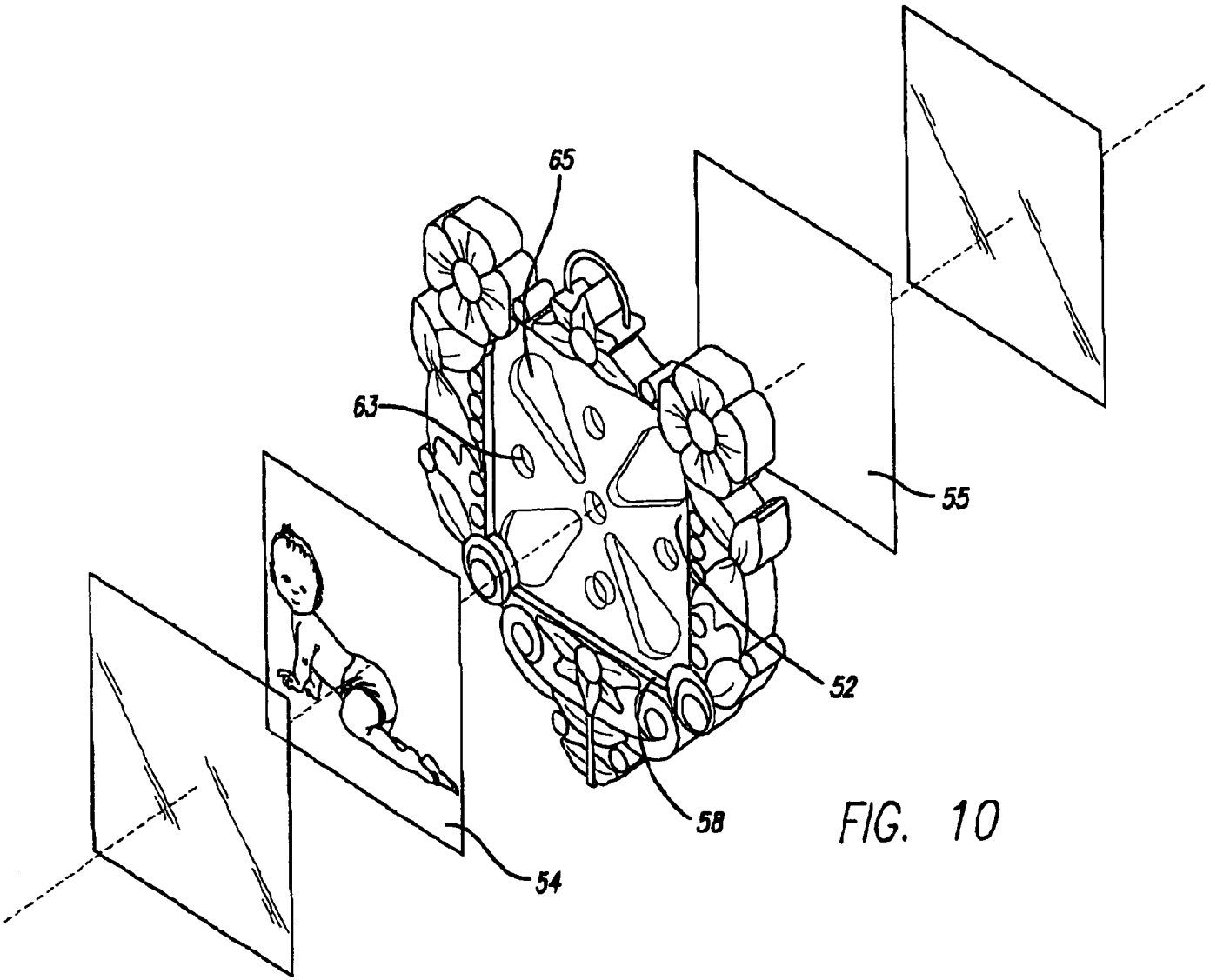
FIG. 10 is an exploded view showing the photographs and their protective coverings apart from their respective framed compartments according to an alternative embodiment of the present invention.
Figure 11:
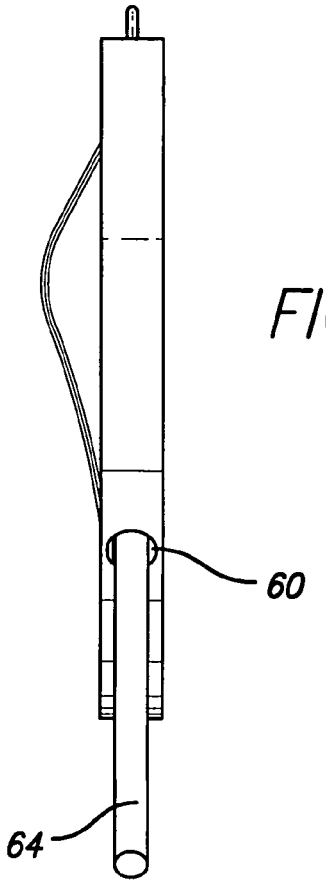
FIG. 11 illustrates the use of the implement inserted through the side wall according to an alternative embodiment of the present invention.
Figure 12:
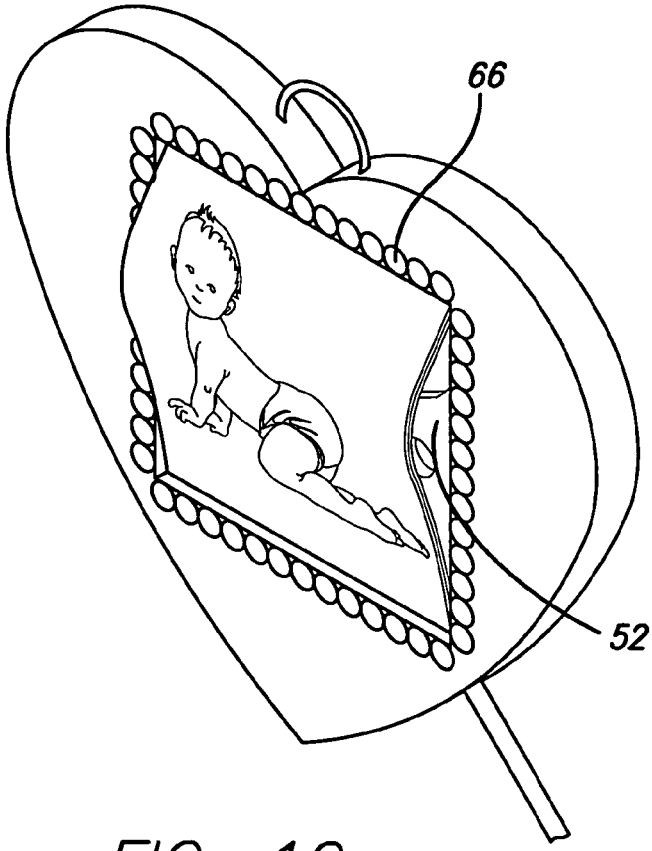
FIG. 12 is a perspective view of the pendant according to an alternative embodiment of the present invention illustrating the use of the implement to dislodge the photograph from the framed compartment.

In a typical application of the present invention, photograph 16 is placed inside compartment 14 as shown in FIG. 1 and FIG. 3A in cross section. To remove the photograph, a narrow implement 42 is employed to penetrate opening 22 and engage photograph 16 from behind pushing it sufficiently forward to separate it from compartment 14, as shown in FIGS. 2, 3B and 3C.

Compartment 14 may be fabricated of any suitable material such as a metal alloy or a resilient synthetic composition. Embellishments, such as a sculpted, embossed or engraved treatments, may be applied to any desired surface of the framed compartment to enhance its aesthetic appeal.

Spacer elements 34 are comprised of any suitably attractive object, though preferably beads of various sizes, shapes and colors.

Wire 32, which is preferably elastic or stretchable, can be comprised of either a natural or synthetic fiber sufficiently thin and resilient enough to easily thread the openings 28 and 30 in the sidewalls 24 and 25 and openings 36 in spacer elements 34 and secure all the bracelet 12 components.

Photograph 16 or any other item with indicia thereon is typically comprised of a paper material, though any size appropriate plastic, metal or natural element would be suitable.

Implement 42 may be a small, slender metal or resilient synthetic poker or pin or even the point of a pencil or pen appropriately sized to fit through opening 22, engage the back of photograph 16 and push it forward bending it slightly to enable the photograph 16 (and the thin protective transparent film, if used) to slip from compartment 14 and separate from it.

Alternative embodiments of the present invention include a pendant 50 having a framed compartment 52 for holding and securing photograph 54 or the like. Pendant 50, which includes embellishments 56 contiguous to framed compartment 52, also includes sidewall 58 having an opening 60 formed generally flush with the sidewall. Pendant 50 also includes a backing plate 62 integrally formed therewith, which may also include assorted other openings 63, 65 of various shapes and sizes provided to reduce costs of material, the weight of the item and to contribute to the article's overall aesthetic appeal. Implement 64, such as a small poker pin, or similar object, is inserted into opening 60 and manipulated in a sideways motion behind photograph 54 to push photograph 54 to ultimately separate it from framed compartment 52.

Pendant 50 may also include framed compartments 52, 53 to hold two photographs in back to back spaced apart relation.

Implement 64 penetrates opening 60 and is manipulated in a lateral motion between and behind photographs 54, 55 to push the photographs away from backing plate 62 and separate them from framed compartments 52 and 53, respectively. New photographs or similar items having some kind of indicia thereon can then be substituted in their place.

Pendant 50 can be generally heart shaped, as shown in the drawings, or can comprise some other geometric configuration. Ornamental features, such as the series of beaded edges 66 circumscribing framed compartment 52, can also be provided to enhance the aesthetics of the jewelry. Floral and similarly creative design embellishments 56 embossed or in some other conventional manner applied or attached to pendant 50, can be provided to further enhance the jewelry's aesthetic appeal.

Implement 64 is typically comprised of some resilient material, such as plastic, with a generally blunt, but smooth, end to enable the photograph(s) to be easily separated from the framed compartment(s) without damaging the photograph(s) in the process.

Opening 60 enables access to a larger elongated space 61 situated behind the photograph(s) to accommodate the size and objective of implement 64. Where two photographs are involved, space 61 provides access to implement 64 to enable the implement to be manipulated between photographs 54 and 55 in order to dislodge either photograph or both from framed compartments 52 and 53, respectively.

At the top 70 of the pendant 50 is provided a hoop 72 or some similar means for attaching a chain (not shown) for use in hanging pendant 50 around a person's neck. If pendant 50 is provided in the form of a pin or broach, a conventional pin or some similar device (not shown) can be attached to the article of jewelry to securely affix the item to the wearer's clothing (not shown). Typically, in such instance, only one photograph with a single framed compartment would be employed.

Other alternate embodiments (not shown) of the present invention include a single compartment 14 fashioned into a ring to be worn on a finger or in combination with a chain, and a single compartment 14 in combination with one or more fanciful or ornamental objects of various sizes, shapes, colors and material compositions.

While the invention will be described in connection with a certain preferred embodiment, it is to be understood that it is not intended to limit the invention to that particular embodiment. Rather, it is intended to cover all alternatives, modifications and equivalents as may be included within the spirit and scope of the invention as defined by the appended claims.

The invention claimed is:

1. An article of jewelry comprising:

a bracelet having a plurality of framed compartments for releasably receiving a small photograph or any similar medium with indicia thereon, said framed compartments being formed of a plate for containing and protecting the back of the photograph and upwardly extending generally flat sidewalls along the perimeter of said plate and formed integrally therewith;

a first opening and a second opening formed flush within opposing said sidewalls of each of said compartments;

means for connecting said compartments to form said bracelet;

one or more ornamentally embellished spacer members to separate each of said compartments from the other and enhance said bracelet flexibility and aesthetics; and, means formed within the integral plate for receiving an implement to engage the photograph and facilitate its release from said framed compartment.

2. The article of jewelry of claim 1 wherein each of said framed compartments includes a means formed within each corner of said compartment for assisting to secure the photograph.

3. The article of jewelry of claim 1 wherein said openings in each of said opposing side walls receives said means for connecting a series of said framed compartments to form a generally circular shaped article of jewelry.

4. The article of jewelry of claim 3 wherein said means for connecting said framed compartments comprises a strand of thin cord.

5. The article of jewelry of claim 4 wherein said strand of thin cord is comprised of a synthetic material.

6. The article of jewelry of claim 5 wherein the material comprising said strand of thin cord is elastic.

7. The article of jewelry of claim 4 wherein said strand of thin cord is comprised of a natural material.

8. The article of jewelry of claim 1 wherein said spacer member is comprised of one or more ornamental beads.

9. The article of jewelry of claim 1 wherein said means formed within the integral plate for receiving an implement to facilitate the release of the photograph comprises a small opening.

10. The article of jewelry of claim 1 further including an implement sized and shaped to allow it to be easily inserted into said small opening and engage said photograph sufficiently enabling it to be pushed forward and completely separate from said framed compartment.

11. The article of jewelry of claim 8 comprising ornamental beads of different sizes, shapes and colors.

12. The article of jewelry of claim 8 wherein each of said ornamental beads contains an opening therethrough to receive said strand of thin cord.

13. The article of jewelry of claim 1 wherein said framed compartment is comprised of metal.

14. The article of jewelry of claim 1 wherein said framed compartment is comprised of a synthetic material.

15. An article of jewelry comprising:

a framed compartment for use individually as a pin, pendant or broach or in combination with other articles of jewelry to form a bracelet or necklace, said framed compartment having means to hold and secure in outwardly opposing relation at least two small photographs or similar media with indicia thereon formed of a plate for containing and protecting the backs of the photographs and for separating the photographs, and sidewalls with means formed flush therewith for receiving an implement to engage and separate said photographs from said framed compartment.

16. The article of jewelry of claim 15 wherein said means formed flush therewith for receiving an implement to engage and separate said photographs from said framed compartment comprises a small opening.

17. The article of jewelry of claim 16 wherein said implement is inserted through said small opening and manipulated laterally behind and between said photographs to dislodge and separate said photographs from said framed compartment.

* * * * *